US007497642B2

(12) United States Patent
Raymond et al.

(10) Patent No.: US 7,497,642 B2
(45) Date of Patent: Mar. 3, 2009

(54) ZERO END CLEARANCE ROLLER FOR A DRUM TYPE COMPACTOR

(76) Inventors: Lawrence Raymond, 8115 Bayridge Ave., Gig Harbor, WA (US) 98332; David Wayne Nolan, 5112 57th Ave. Ct. W., University Place, WA (US) 98467

( * ) Notice: Subject to any disclaimer, the term of this patent is extended or adjusted under 35 U.S.C. 154(b) by 0 days.

(21) Appl. No.: 11/818,809

(22) Filed: Jun. 15, 2007

(65) Prior Publication Data

US 2008/0310918 A1 Dec. 18, 2008

(51) Int. Cl.
*E01C 19/26* (2006.01)
*E01C 19/24* (2006.01)

(52) U.S. Cl. ..... 404/132; 404/117; 404/122; 404/124

(58) Field of Classification Search ..... 404/117, 404/122–124, 128, 132
See application file for complete search history.

(56) References Cited

U.S. PATENT DOCUMENTS 118,616 A * 8/1871 Kelly ..... 404/132
119,132 A * 9/1871 Dunham ..... 292/242
474,038 A * 5/1892 Baugh ..... 404/129
482,406 A * 9/1892 Geisendorfer ..... 404/130
546,194 A * 9/1895 Shaw ..... 404/132
635,279 A * 10/1899 Corbin ..... 404/132
1,052,643 A * 2/1913 Baechle ..... 404/132
1,104,502 A * 7/1914 Hist ..... 404/130
1,190,257 A * 7/1916 Henderson ..... 404/126
1,607,672 A * 11/1926 Gray ..... 404/122
1,842,717 A * 1/1932 Doyle ..... 404/132
4,231,678 A 11/1980 Carternock
4,964,753 A 10/1990 Ciminelli et al.

* cited by examiner

*Primary Examiner*—Raymond W Addie

(57) ABSTRACT

A roller type asphalt pad and/or soil compactor adapted to compact asphalt paving and sub-grading closely adjacent to building walls, poles, edgings, curbs, and barriers. The roller comprises at least one end having an axially offset cylindrical extension having a recessed hub, or no hub, which allows the extension to compress the paving without having a hub or similar end attachment that prevents the roller assembly from working snugly against a wall or barrier.

7 Claims, 3 Drawing Sheets

Section A-A

ZERO END CLEARANCE ROLLER FOR A DRUM TYPE COMPACTOR

BACKGROUND OF THE INVENTION

1. Field of the Invention

Powered roller drum type soil and pavement compactors. In particular, having the axle ends recessed; permitting the roller to work adjacent to walls and the like without being offset by the roller supports, hubs, and bearings.

2. Description of Related Art

Roller compactors currently have at least one heavy roller supported by framework with axial bearings attached to the ends of a roller drum. The framework and bearings extend beyond the end of the roller, thus preventing the roller edge from working closely against barriers such as walls, poles, posts, curbs, and other barriers rising as high as the roller carrier structures.

To permit close working, one prior art method has the roller divided in the center so a framework can be attached to the Axle interiorly from the drum edges. This leaves a gap, which causes the operator to make a redundant pass over the un-compacted ridge left by the gap, or to employ additional rollers leading or following the gapped roller. U.S. Pat. No. 4,964,753, by Michael Ciminelli is of this type. Ciminelli's compactor uses a single non-steerable front roller and a pair rear rollers with recessed hubs. The front roller is used to flatten the un-compacted ridge left by the back rollers. Steering is accomplished by independent control of the forward and backward rotation of the rear rollers. The Ciminelli drawings suggest that his compactor possibly may work in zero clearance situations, although he does not state or suggest using it in that manner.

Another method for supporting and controlling a roller without the frame being beyond the ends of the roller drum is shown in U.S. Pat. No. 4,231,678, by Frederick Carternock. Carternock supports the roller externally by a C section carrying a plurality of wheels spaced around the drum, thereby capturing drum with a ring of external wheels. This requires a high, heavy, frame to hold the C section over the compactor drum.

The present invention places three compaction rollers on adjacent, parallel, offset axes. Thus compaction occurs over contiguous collinear ground engaging surfaces at the bottoms of the drums. The result is no ridges left that would require additional passes or tandem rollers for removing ridges.

3. Objects of the Invention

It is an object of the invention to provide a roller type compactor where the compacting drum can work adjacent to a vertical barrier such as a wall, pole, post, and the like without leaving an un-compacted strip adjacent to the barrier.

BRIEF SUMMARY OF THE INVENTION

A roller compactor is a heavy 2 axle machine where at least one axle carries roller for compressing materials as the machine travels. The other axle may have another compacting roller, rubber tires, or a caterpillar tread. Steering is usually accomplished by pivoting one of the axles.

The prior art frame and bearing systems have been described as lacking the ability to work closely against walls, poles, curbs, etc. The invention described herein overcomes this problem.

The main roller is divided into three adjacent, independent, ground contacting roller sections on parallel axles. The rollers are designated as a central, and left and right outer rollers. The central and outer rollers are supported from downwardly extending plates of a suspension frame over the middle roller. The central roller axle is journaled to the plates by bearings at each end. The outer rollers are journaled on separate axles extending outwardly from the plates. The outer rollers have a larger diameter than the central roller and all three are in alignment on the ground, thus the axles of the outer rollers are parallel with, but attached to the plate above the center roller axle.

The bottom (ground contacting) surfaces of all the roller drums are co-planer, but the tops of the outer rollers extend above the upper surface of the center roller drum, thereby leaving a space for the supporting frame, to pass through and extend downward to the roller axles.

Bearings of suitable size and shape are attached to the rollers and axles.

TABLE OF IDENTIFIED DETAILS

Figure 1:
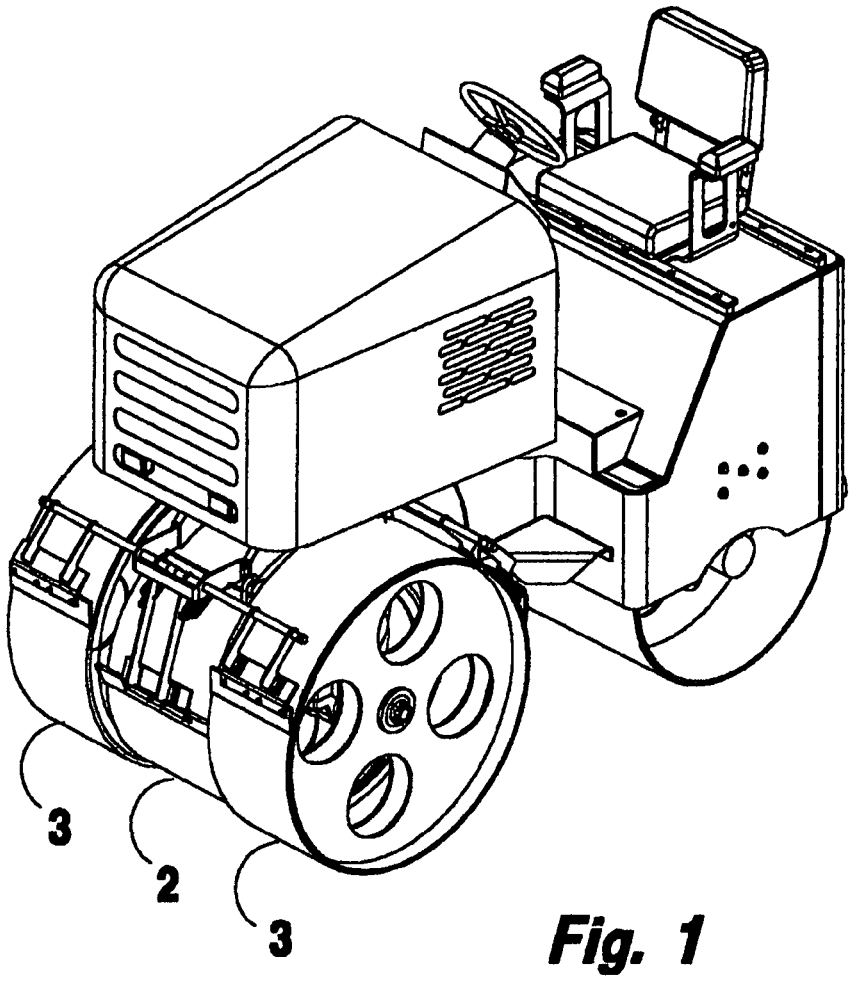
FIG. 1 is an isometric view showing the 3 section roller assembly on a compacting machine.
Figure 5:
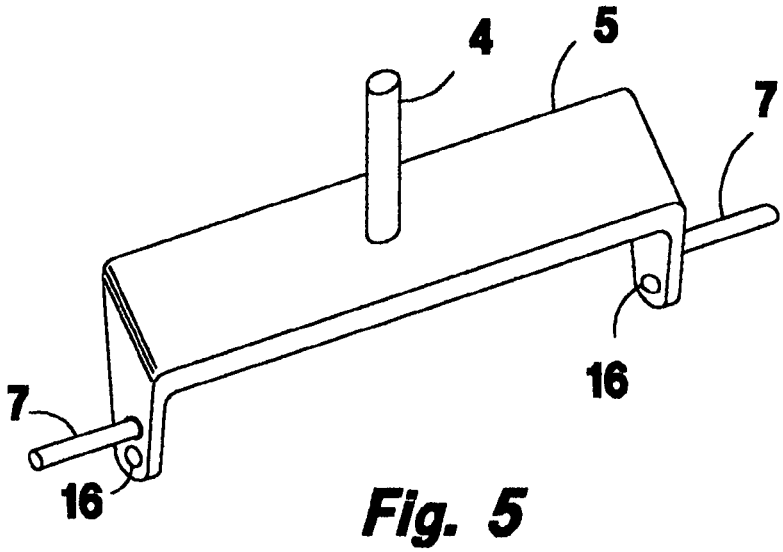
FIG. 5 is a view showing the essential parts of the roller suspension frame.

1. The roller drum compactor fitted with the described 3 section roller.
2. The primary drum
3, 3*a*, 3*b*. The secondary outside drums
4. Steering trunnion
5. Drum support frame(from trunnion to axle)
6. Primary (center) drum axle
7. Outer drum axle(2)
8. Ground contacting area of the drums
9. Unassigned
10. Outer drum wheel disks
11. Outer drum axle bearing assembly
12. Center drum axle bearing assembly
13. Center drum wheel disks
14. Drive motor, chain, sprockets, etc
15. Drum shield ring
16. Journaling mount for central roller axle

DETAILED DESCRIPTION OF THE INVENTION

FIG. 1 illustrates a soil or pavement compactor 1 fitted with the present invention. The primary roller comprising three independent, adjacent rolling drums. The center roller 2 is driven by an hydraulic motor 14. The outer rollers 3*a*, 3*b* are on independent axles 12 attached to a frame 5 at a position above the center roller axle 6. The preferred diameter of the center roller 2 is 30 inches, and the preferred diameter of the outer rollers is 36 inches. The axles are positioned to have the lower, ground contacting, surfaces of the drums aligned co-planarly. Thus there is a gap diametrically opposite (at the top of the drums) through which the axle supporting frame 5 is passed. The frame also carries at its center a pivot trunnion 4 for pivoting the roller assembly about a vertical axis to steer the machine. The pivot trunnion is operatively attached to an operator controlled steering mechanism.

Figure 2:
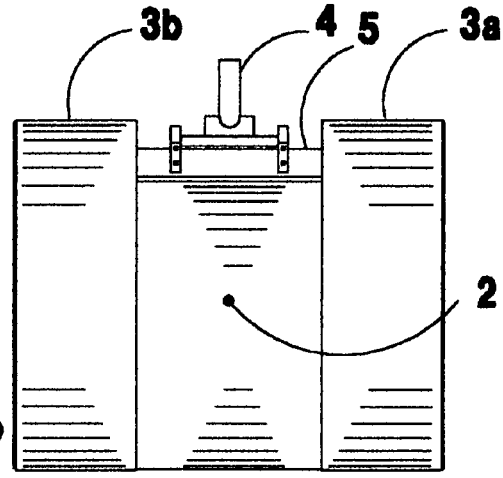
FIG. 2 is an frontal view of the preferred embodiment of the 3 drum roller assembly.

FIG. 2 is an exterior frontal view showing the three rollers 2, 3*a*, 3*b*, part of the axle supporting frame 5, and the steering trunnion 4. Since the axles are at the centers of the rollers, the axle offset is implied. The relationship of the top and ground contacting edges are illustrated.

With the ground contacting portions of the three drums being aligned co-linearly, the three drums accomplish compacting and smoothing operations nearly identically as if they were one longer roller.

Figure 3:
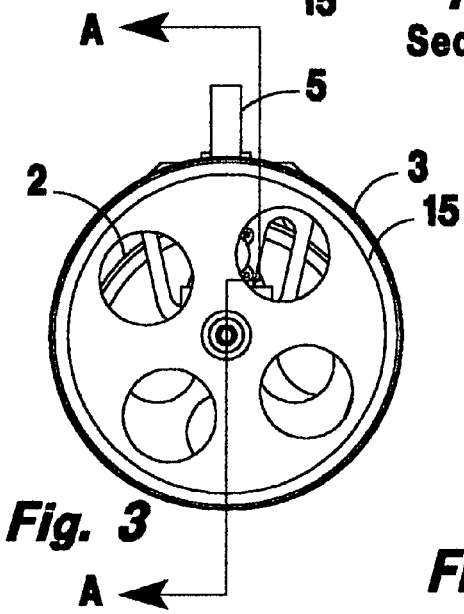
FIG. 3 is an end view of the drum assembly of the preferred embodiment.

FIG. 3 as an end view of the rollers. The cut-line for FIG. 4 is illustrated.

Figure 4:
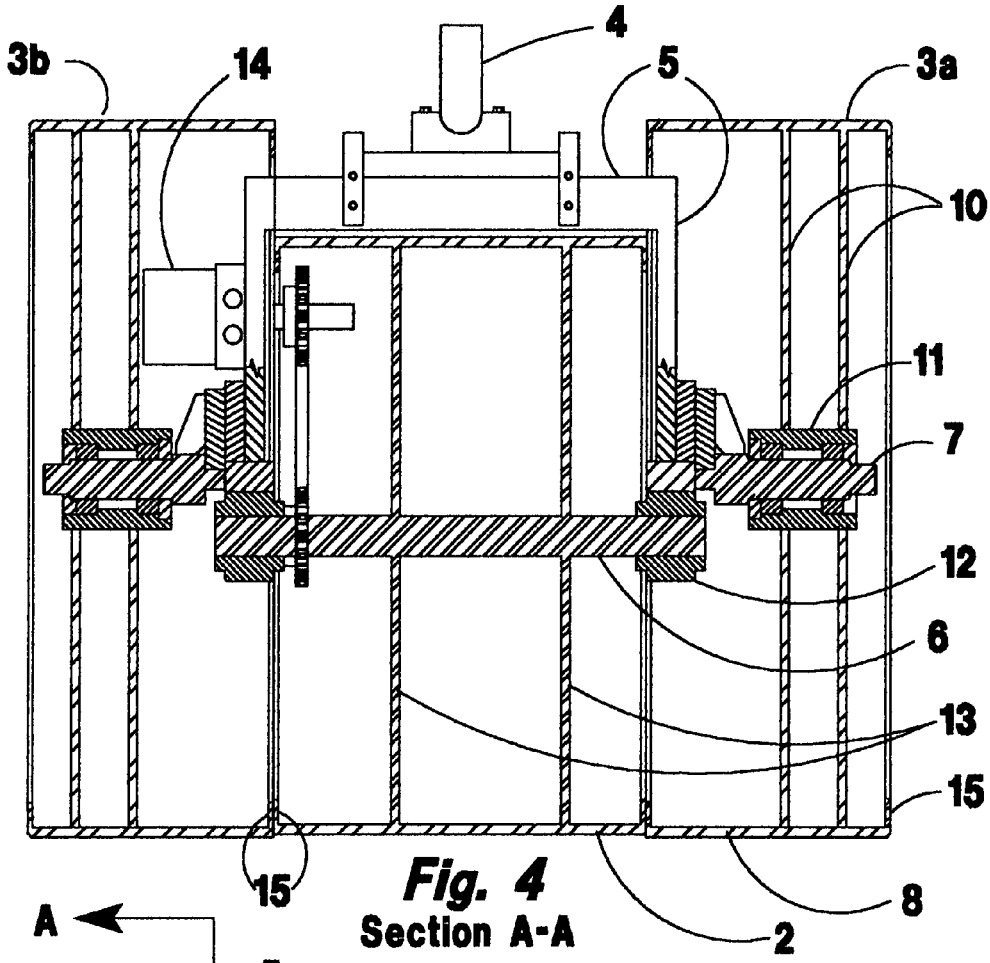
FIG. 4 is a cut away view of the 3 roller drums cut along sectioning line A-A.

Referring to FIG. 4, The structure of the rollers, axles, and the bearings are illustrated. The two outer drums are generally identical, and the identified features apply to both.

The three drums are similarly constructed comprising an outer cylinder 2, 3, and at least two spaced apart interior wheels 10, 13 which extend between the axles or axle bearings and the outer cylinders.

The center roller has one of the wheels moved inward to make space for the chain drive assembly. At least one of the outer rollers has one wheel moved outwardly enough to make space for the hydraulic drive motor and associated drive parts 14. The wheels 13 for the center roller and the chain drive sprocket are securely attached to the center axle 6. Thus, power from motor 14 is passed through the chain and sprocket to the axle 6, then through wheels 13, and finally to the center roller cylinder 2 to drive the machine forwards and backwards.

The wheels of the outer rollers extend between the roller cylinder 3 and a bearing hub 11. Roller or ball bearings permit the outer rollers to rotate freely.

Access holes through the wheels are provided to gain admittance into the interior of the roller drums for cleaning, repair, assembly, disassembly, greasing, and general maintenance.

Bearing details such as mounting, type, design, etc, and hub capping are conventional, and not described in detail.

In addition, each open end of each roller drum has a shield ring 15 welded to the cylinder for both strengthening and to serve as partial end walls to keep most if not all loose gravel, dirt, asphalt, etc from entering the cylinders. This is especially required for the adjacent roller ends. Debris in there would not be easily expelled and could even wedge in the scissors-like spaces where the rollers of different diameters converge toward bottom. The preferred ring width is 1¼ inch, but may be much larger for the outer rim of the outer rollers and for both ends of the center roller. The width of the rings 15 at the inner edges of the outer rollers 3 must be small enough to leave an adequate gap at the top for the supporting frame 5 to pass between the outer rollers and the center roller.

The prime mover (engine), hydraulic, and steering systems are conventional for machinery of this class, thus does not need to be described.

Alternative Embodiments and Variations of the Invention

The foregoing description utilizes the composite roller assembly as one of the rollers on a conventional tandem roller riding compactor comprising a chassis supporting a prime mover and associate machinery, an operator's station, and operator's controls for steering and movement. The claimed invention is intended to be mountable on other forms such as a walk-behind machine similar to the general form described by Ciminelli U.S. Pat. No. 4,964,753, multiple axle roller compactors, and rollers towed or pushed by tractors, graders, trucks, hoes, loaders, dozers, and other construction machinery.

The invention may be practiced with only one outer roller having the claimed recessed hub.

FIG. 1 illustrates the back of the compactor machine being supported on a single transverse roller. However, the second support may be another of the presently described roller assembly, rubber tires, or a crawler track.

The rollers are generally smooth for making flat surfaces, but may optionally be equipped with knobs, bars, sheep's-foot like projections, etc for deeper compactions operations or to increase traction.

The dimensions presented are for a preferred size of compacting machine. Obviously, the compactor may be scaled up or down to fit particular applications.

Figure 6:
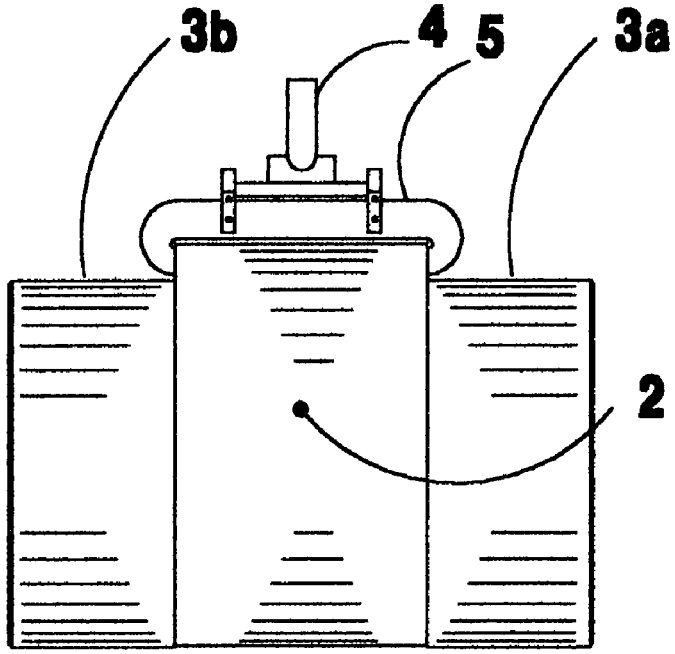
FIG. 6 is an end view of an embodiment of the drum assembly where the outer roller drums have a smaller diameter than the center roller drum.
Figure 7:
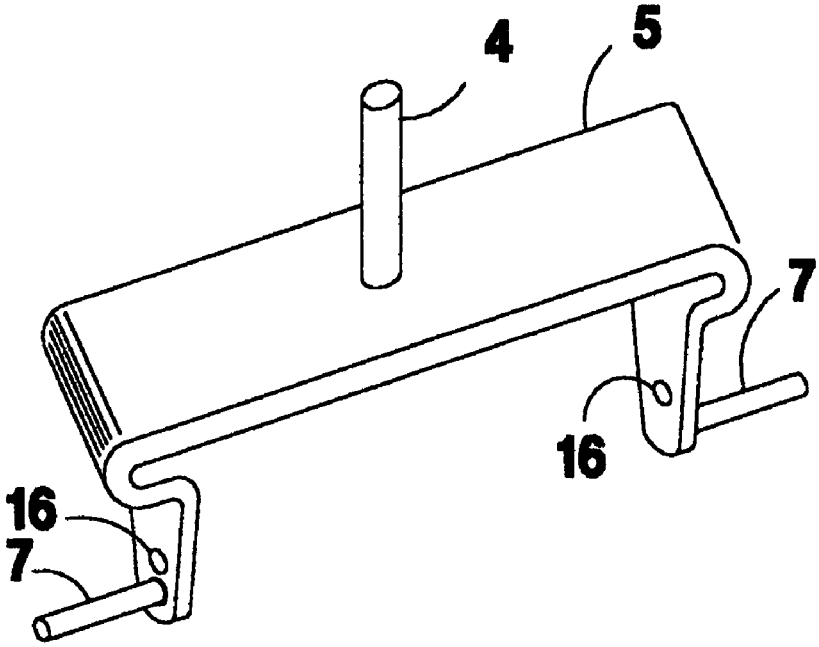
FIG. 7 is a view showing the essential parts of the roller suspension frame adapted for use when the outer rollers are smaller than the central drum.

The description of the preferred embodiment has the outer rollers having diameters larger than the center roller. The invention may be configured where the outer rollers have a smaller diameter than the center roller. FIGS. 6 and 7 show the modifications to the preferred embodiment to utilize smaller outer rollers. The supporting frame has a retro bend extending through the gap under the central roller at least far enough to clear the inner edge of the outer rollers. There is enough space within the outer rollers to accommodate the hubs and bearings of the central roller axle. Alternatively, the retro-portion may be extended inwardly enough to keep the entire central axle assembly within the central roller. Obviously, this will necessitate an heavier structure in the zone of the retro-bend and inward extension to carry the load of the chassis and engine.

How to Use the Invention

The compactor machine is controlled by an on-board operator who may run the compactor against curbs, walls, poles, etc.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention as defined by the claims which follow.

The embodiments of the invention in which an exclusive property right or privilege is claimed are defined as follows.

We claim:

1. A drum roller for a compacting machine comprising:

a. a first roller drum having a central axle rotably journaled to a supporting frame adapted to attach to the chassis of a compacting machine, said first roller being a cylinder having a ground contacting zone and end edges perpendicular to said axle, and b. a second cylindrical roller having a diameter different than said first roller, said second roller journaled to a central axle having one end attached to said supporting frame, and extending outwardly through and terminating within said second roller, and a ground contacting zone closely adjacent and parallel to the ground contacting zone of said first roller, and c. a gap between the rims of said first and second rollers for admitting said supporting frame to the region of said axles, whereby d. said ground contacting surfaces co-operate as a single surface to compact material under the rollers, and said second roller having the hub of its axle within the cylinder of said second roller whereby the compactor is adapted to operate closely adjacent to obstacles.

2. The drum roller of claim 1 where the second roller has a larger diameter than the first roller.

3. The drum roller of claim 1 where the second roller has a smaller diameter than the first roller.

4. The drum roller of claim 1 further comprising a third cylindrical roller adjacent to the first roller end opposite the second roller, and said third roller having a diameter different than said first roller, said third roller journaled to a central axle having one end attached to said supporting frame, and extending outwardly through and terminating within said third roller, and a ground contacting zone closely adjacent and parallel to the ground contacting zone of said first roller, and a gap between the rims of said first and third rollers for admitting said supporting frame to the region of said axles, whereby said ground contacting surfaces co-operate as a single surface to compact material under the rollers, and said third roller having the hub of its axle within the cylinder of said third roller is adapted to operate closely adjacent to obstacles.

5. A drum roller for a compacting machine comprising:

a. a first roller drum having a central axle rotably journaled to a supporting frame adapted to attach to the chassis of a compacting machine, said first roller being a cylinder having a ground contacting zone and end edges perpendicular to said axle, and b. second and third cylindrical rollers each having diameters different than said first roller, said second and third rollers each journaled individually to cooperating central axles, each having one end attached to said supporting frame, and extending outwardly through and terminating within said cooperating rollers, and ground contacting zones closely adjacent and parallel to the ground contacting zone at each end of said first roller, and c. gaps between the rims of said first and second rollers and first and third rollers for admitting said supporting frame to the region of said axles, whereby d. said ground contacting surfaces co-operate as a single surface to compact material under the rollers, and said second and third rollers each having the hub of its axle within the cylinder of said second or third roller whereby the compactor is adapted to operate closely adjacent to obstacles.

6. The drum roller of claim 5 where the second and third rollers have larger diameters than the first roller.

7. The drum roller of claim 5 where the second third rollers have smaller diameters than the first roller.

* * * * *